US011174862B2

(12) United States Patent
Miyamura et al.

(10) Patent No.: US 11,174,862 B2
(45) Date of Patent: Nov. 16, 2021

(54) SCREW COMPRESSOR

(71) Applicant: DAIKIN INDUSTRIES, LTD., Osaka (JP)

(72) Inventors: Harunori Miyamura, Osaka (JP); Hiromichi Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 669 days.

(21) Appl. No.: 16/074,343

(22) PCT Filed: Feb. 7, 2017

(86) PCT No.: PCT/JP2017/004387
§ 371 (c)(1),
(2) Date: Jul. 31, 2018

(87) PCT Pub. No.: WO2017/141768
PCT Pub. Date: Aug. 24, 2017

(65) Prior Publication Data

US 2021/0190069 A1 Jun. 24, 2021

(30) Foreign Application Priority Data

Feb. 17, 2016 (JP) ..... JP2016-027536

(51) Int. Cl.
*F04C 18/16* (2006.01)
*F04C 29/06* (2006.01)
*F04C 29/12* (2006.01)

(52) U.S. Cl.
CPC ..... *F04C 18/16* (2013.01); *F04C 29/065* (2013.01); *F04C 29/12* (2013.01); *F04C 2240/30* (2013.01); *F04C 2250/102* (2013.01)

(58) Field of Classification Search
CPC ..... F04C 18/16; F04C 18/52; F04C 18/084; F04C 29/065; F04C 29/12; F04C 2240/20; F04C 2240/30; F04C 2250/102
(Continued)

(56) References Cited

U.S. PATENT DOCUMENTS

2013/0171018 A1* 7/2013 Inoue ..... F04C 28/12 418/191
2013/0216418 A1* 8/2013 Masuda ..... F04C 29/068 418/191
(Continued)

FOREIGN PATENT DOCUMENTS

CN 104963872 A 10/2015
JP 2001-65483 A 3/2001
(Continued)

OTHER PUBLICATIONS

European Search Report of corresponding EP Application No. 17 75 3026.8 dated Apr. 8, 2019.
(Continued)

*Primary Examiner* — Audrey B. Walter
*Assistant Examiner* — Dapinder Singh
(74) *Attorney, Agent, or Firm* — Global IP Counselors, LLP

(57) ABSTRACT

A screw compressor includes a casing having an outer peripheral wall, and a compression mechanism. The compression mechanism includes a screw rotor with helical grooves, a gate rotor with a plurality of gates meshing with the helical grooves, and a cylinder housing the screw rotor. The compression mechanism is disposed inward of the outer peripheral wall. The outer peripheral wall has a discharge passage through which a fluid compressed in the compression mechanism flows. The discharge passage includes an inner peripheral passage formed along an outer peripheral surface of the cylinder, and an outer peripheral passage formed along the inner peripheral passage and the outer peripheral wall. The inner and outer peripheral passages are formed so that the fluid compressed in the compression mechanism sequentially flows through the inner and outer peripheral passages.

4 Claims, 7 Drawing Sheets

(58) Field of Classification Search
USPC ..... 418/201.1
See application file for complete search history.

(56) References Cited

U.S. PATENT DOCUMENTS

| | | | | |
|---|---|---|---|---|
| 2014/0083130 | A1* | 3/2014 | Picouet | F04C 29/0007 62/434 |
| 2018/0142689 | A1 | 5/2018 | Chen et al. | |
| 2018/0172002 | A1* | 6/2018 | Desiron | F04C 29/045 |

FOREIGN PATENT DOCUMENTS

| | | | |
|---|---|---|---|
| JP | 2013-253543 | A | 12/2013 |
| JP | 2014-125913 | A | 7/2014 |

OTHER PUBLICATIONS

International Search Report of corresponding PCT Application No. PCT/JP2017/004387 dated Apr. 4, 2017.
International Preliminary Report of corresponding PCT Application No. PCT/JP2017/004387 dated Aug. 30, 2018.

* cited by examiner

SCREW COMPRESSOR

CROSS-REFERENCE TO RELATED APPLICATIONS

This U.S. National stage application claims priority under 35 U.S.C. § 119(a) to Japanese Patent Application No. 2016-027536, filed in Japan on Feb. 17, 2016, the entire contents of which are hereby incorporated herein by reference.

BACKGROUND

Field of the Invention

The present invention relates to a screw compressor.

Background Information

Screw compressors including a compression mechanism having a screw rotor and gate rotors have been known.

Japanese Unexamined Patent Publication No. 2013-253543 discloses a screw compressor of this kind. In this compressor, a plurality of gates of the gate rotors mesh with helical grooves of the screw rotor, and the screw rotor is housed in a cylinder. Thus, a compression chamber for fluid compression is formed by the screw rotor, the gates, and the cylinder.

In this compressor, a fluid compressed in the compression mechanism flows into a high-pressure space via a discharge passage. The discharge passage is formed along an outer peripheral surface of the cylinder. Specifically, the fluid of a high temperature discharged from the compression mechanism heats the cylinder, and then is guided toward the high-pressure space. In this configuration, owing to the difference in thermal expansion property between the screw rotor and the cylinder, contact between an inner peripheral surface of the cylinder and the rotating screw rotor can be prevented, and eventually, the seizing of the screw rotor can be avoided.

SUMMARY

The discharge passage according to Japanese Unexamined Patent Publication No. 2013-253543 includes, in a strict sense, a first passage in which a discharge port of the compression mechanism opens, and a second passage downstream of the first passage. The first and second passages are circumferentially arranged along an inner peripheral surface of an outer peripheral wall of a casing, and extend in an axial direction of the cylinder. The fluid discharged from the compression mechanism flows into the first passage via the discharge port, and then flows in the axial direction of the cylinder toward the suction side (toward a low-pressure space) of the compression mechanism. The fluid that has flowed out of the first passage flows in a different direction, i.e., in the circumferential direction of the cylinder, and then goes into the second passage. The fluid in the second passage flows in the axial direction of the cylinder toward the discharge side (toward a discharge space) of the compression mechanism, and is guided to the high-pressure space.

The present inventors have found a problem associated with the discharge passage according to the prior art, i.e., noise that increases due to pulsation of the fluid compressed in the compression mechanism. Specifically, the fluid that has just been compressed in the compression mechanism flows into the first passage described above, which may easily cause the pulsation of the fluid (this may also be called discharge pulsation). The first passage opens in the discharge port, and is formed along the inner peripheral surface of the outer peripheral wall of the casing. Thus, sound generated by the pulsation in the first passage is easily transferred to the outside via the casing, which may disadvantageously increase the noise. Such a problem becomes more remarkable as the size and speed of the compression mechanism increases.

In view of the foregoing, the present invention has been achieved to provide a screw compressor which can heat the cylinder with the fluid, and can reduce the noise derived from the pulsation of the fluid in the discharge passage.

A first aspect of the present invention is directed to a screw compressor. The screw compressor includes: a casing (11) having an outer peripheral wall (65); and a compression mechanism (30) including a screw rotor (40) provided with helical grooves (41), a gate rotor (50) including a plurality of gates (54) meshing with the helical grooves (41), and a cylinder (31) housing the screw rotor (40), the compression mechanism (30) being disposed inward of the outer peripheral wall (65), wherein a discharge passage (70) through which a fluid compressed in the compression mechanism (30) flows is formed inside the outer peripheral wall (65), and the discharge passage (70) includes an inner peripheral passage (71) formed along an outer peripheral surface of the cylinder (31) to extend in an axial direction of the cylinder (31), and an outer peripheral passage (75) formed along the inner peripheral passage (71) and the outer peripheral wall (65) to extend in the axial direction of the cylinder (31), so that the fluid compressed in the compression mechanism (30) sequentially flows through the inner peripheral passage (71) and the outer peripheral passage (75).

According to the first aspect, the fluid compressed in the compression mechanism (30) first flows through the inner peripheral passage (71). The inner peripheral passage (71) is formed along the outer peripheral surface of the cylinder (31). Thus, the cylinder (31) can be heated by the fluid which has just been compressed and is relatively high in temperature. As a result, owing to the difference in thermal expansion property between the screw rotor (40) and the cylinder (31), contact between an inner peripheral surface of the cylinder (31) and the rotating screw rotor (40) can be prevented, and eventually, the seizing of the screw rotor (40) can be avoided.

Being surrounded by the outer peripheral passage (75), the inner peripheral passage (71) is located further away from the outer peripheral wall (65) of the casing (11) than a passage according to the prior art. Thus, noise derived from the pulsation of the fluid flowing in the inner peripheral passage (71) is not easily transferred to the outside of the casing (11).

The fluid that has flowed out of the inner peripheral passage (71) flows through the outer peripheral passage (75). The outer peripheral passages (75) is located downstream of the inner peripheral passage (71). Consequently, the discharge pulsation of the fluid flowing through the outer peripheral passage (75) is smaller than that of the fluid flowing through the inner peripheral passage (71). Thus, even if the outer peripheral passage (75) is formed along the casing (11), the noise caused by the pulsation of the fluid in the outer peripheral passage (75) is not greatly transferred to the outside of the casing (11).

A second aspect of the invention is an embodiment of the first aspect. In the second aspect, the discharge passage (70) is configured such that a fluid flows in a certain direction in the inner peripheral passage (71) and flows in an opposite direction to the certain direction in the outer peripheral passage (75), and includes a communication passage (73) through which a downstream end of the inner peripheral passage (71) communicates with an upstream end of the outer peripheral passage (75).

According to the second aspect, the direction of the fluid flowing in the inner peripheral passage (71) is opposite to the direction of the fluid flowing in the outer peripheral passage (75). Thus, the fluid that has flowed out of the inner peripheral passage (71) makes a U-turn to flow into the outer peripheral passage (75). As a result, the pulsation of the fluid flowing trough the outer peripheral passage (75) is further reduced.

A third aspect of the invention is an embodiment of the first or second aspect. In the third aspect, an outer peripheral surface of the inner peripheral passage (71) is entirely surrounded by the outer peripheral passage (75).

According to the third aspect, the inner peripheral passage (71) is entirely located away from the casing (11). This can effectively avoid the sound generated by the pulsation of the fluid in the inner peripheral passage (71) from being transmitted to the outside of the casing (11).

According to the first aspect of the invention, the outer peripheral passage (75) is provided between the inner peripheral passage (71) and the outer peripheral wall (65) of the casing (11). This can reduce the noise derived from the pulsation of the fluid.

The inner peripheral passage (71), in which a relatively high temperature fluid flows, is formed along the outer peripheral surface of the cylinder (31). This can heat the cylinder (31) with the fluid more efficiently. As a result, the seizing of the screw rotor (40) can effectively be avoided.

According to the second aspect of the invention, the refrigerant makes a U-turn in the discharge passage (70). This can effectively reduce the discharge pulsation of the fluid flowing through the outer peripheral passage (75), thereby further reducing the noise.

According to the third aspect of the invention, the outer peripheral passage (75) entirely covers the inner peripheral passage (71), which makes it possible to further reduce the noise transmitted to the outside of the casing (11).

DETAILED DESCRIPTION OF EMBODIMENT(S)

Embodiments of the present invention will be described in detail with reference to the drawings.

Figure 1:
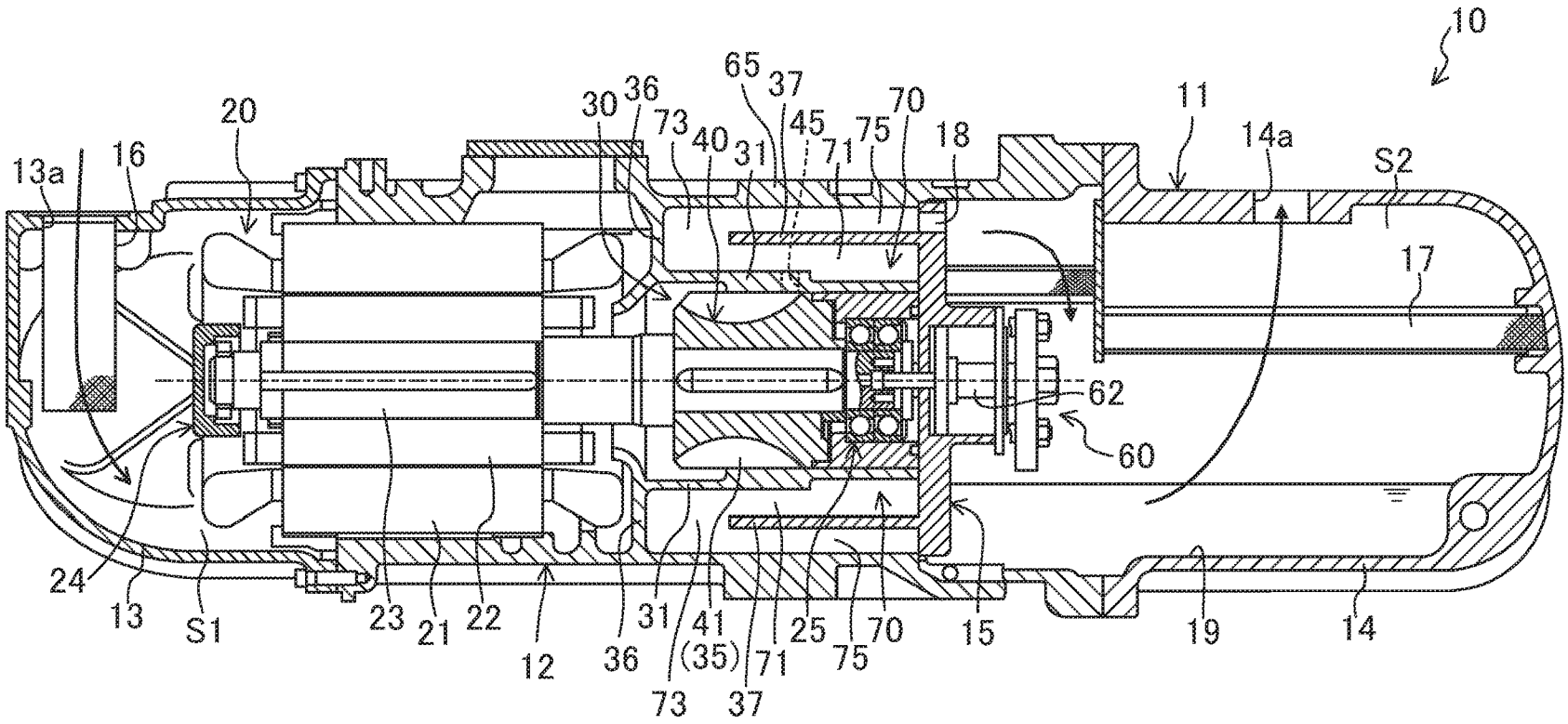
FIG. 1 is a vertical cross-sectional view illustrating the configuration of a screw compressor according to an embodiment of the present invention.

A screw compressor (10) shown in FIG. 1 is connected to, for example, a refrigerant circuit of a refrigeration apparatus. In the refrigerant circuit, a refrigerant discharged from the screw compressor circulates to perform a refrigeration cycle.

Figure 2:
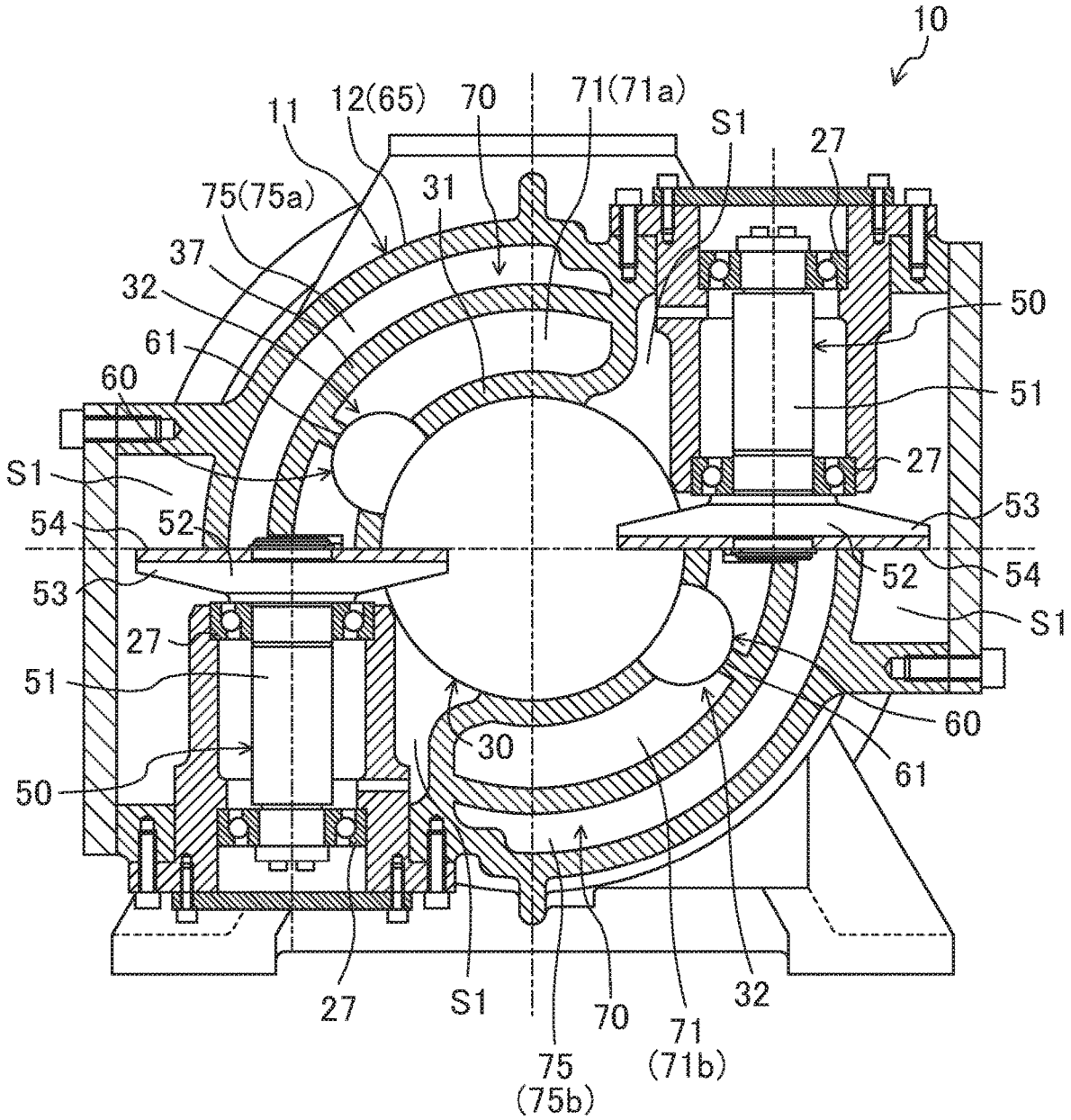
FIG. 2 is a transverse cross-sectional view illustrating the vicinity of a compression mechanism of the screw compressor.

As shown in FIGS. 1 and 2, the screw compressor (10) includes a casing (11), a motor (20), a drive shaft (23), a compression mechanism (30), and a slide valve mechanism (60).

Casing

The casing (11) shown in FIG. 1 is a semi-hermetic, transversely oriented container made of metal. The casing (11) includes a casing body (12), a suction side cover (13), and a discharge side cover (14). An open end of the suction side cover (13) is fixed to a longitudinal end (a left end in FIG. 1) of the casing body (12). An open end of the discharge side cover (14) is fixed to another longitudinal end (a right end in FIG. 1) of the casing body (12).

A suction portion (13*a*), to which a suction pipe is connected, is formed at the top of the suction side cover (13). The suction portion (13*a*) is connected to a low-pressure gas line of the refrigerant circuit. A low pressure refrigerant to be sucked into the screw compressor (10) flows into the suction portion (13*a*). A discharge portion (14*a*) is formed at the top of the discharge side cover (14). The discharge portion (14*a*) is connected to a high-pressure gas line of the refrigerant circuit. A high pressure refrigerant compressed in the screw compressor (10) flows into the discharge portion (14*a*).

A low-pressure space (S1), which may also be called a "suction space," is formed in the casing (11) in front of the compression mechanism (30) (on the left in FIG. 1). A low pressure refrigerant to be sucked into the compression mechanism (30) flows into the low-pressure space (S1). A filter (16) for capturing foreign matters in the low pressure refrigerant is provided in the low-pressure space (S1).

A high-pressure space (S2), which may also be called a "discharge space," is formed in the casing (11) behind the compression mechanism (30) (on the right in FIG. 1). A high pressure refrigerant discharged from the compression mechanism (30) flows into the high-pressure space (S2). A demister (17) for separating oil from the high pressure refrigerant is provided in the high-pressure space (S2).

The discharge side cover (14) has an oil sump (19) located below the high-pressure space (S2). The oil sump (19) stores oil that lubricates sliding portions of the compression mechanism (30) and bearings (24, 25, 27). The oil in the oil sump (19) is supplied to the sliding portions via an oil passage (not shown) formed through a discharge side partition (15).

The casing body (12) includes a substantially cylindrical outer peripheral wall (65) surrounding the compression mechanism (30). Specifically, the compression mechanism (30) is disposed inward of the outer peripheral wall (65).

Motor and Drive Shaft

The motor (20) is arranged in the low-pressure space (S1). The motor (20) includes a stator (21) and a rotor (22). The stator (21) is fixed to an inner peripheral surface of the casing body (12). The rotor (22) penetrates the stator (21), and is rotatable in the stator (21). The drive shaft (23) is fixed at the center of the rotor (22).

The drive shaft (23) extends in a horizontal direction along the longitudinal direction of the casing (11). An end (a left end in FIG. 1) of the drive shaft (23) is rotatably supported by a first bearing (24) which is, for example, a roller bearing. Other end (a right end in FIG. 1) of the drive shaft (23) is rotatably supported by a second bearing (25) which is, for example, a ball bearing.

Compression Mechanism

The compression mechanism (30) includes a cylinder (31), a screw rotor (40), and two gate rotors (50). In the compression mechanism (30), the cylinder (31), the screw rotor (40), and the gate rotors (50) form a compression chamber (35) for compressing the fluid (refrigerant).

Cylinder

The cylinder (31) serves as a partition that defines the compression chamber (35). The cylinder (31) is formed between the motor (20) and the discharge side partition (15). A substantially columnar space for housing the screw rotor (40) is formed inside the cylinder (31). Further, a valve housing (32) for housing a slide valve (61) is formed inside the cylinder (31).

Screw Rotor

Figure 3:
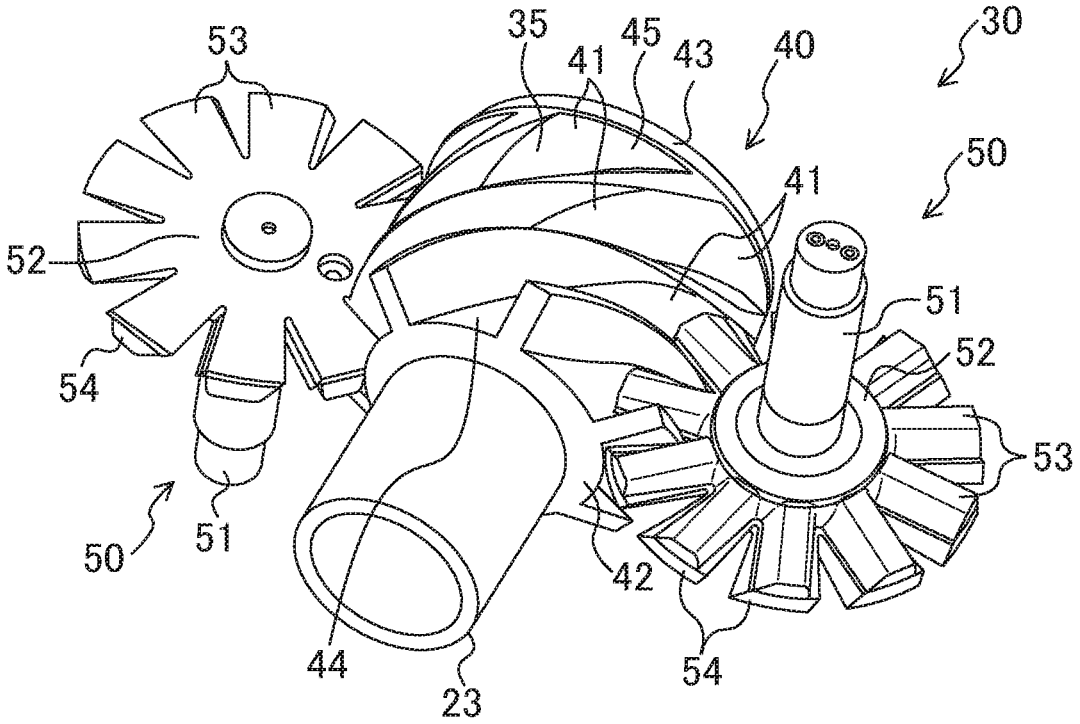
FIG. 3 is a perspective view illustrating a major part of the compression mechanism as viewed from above.
Figure 4:
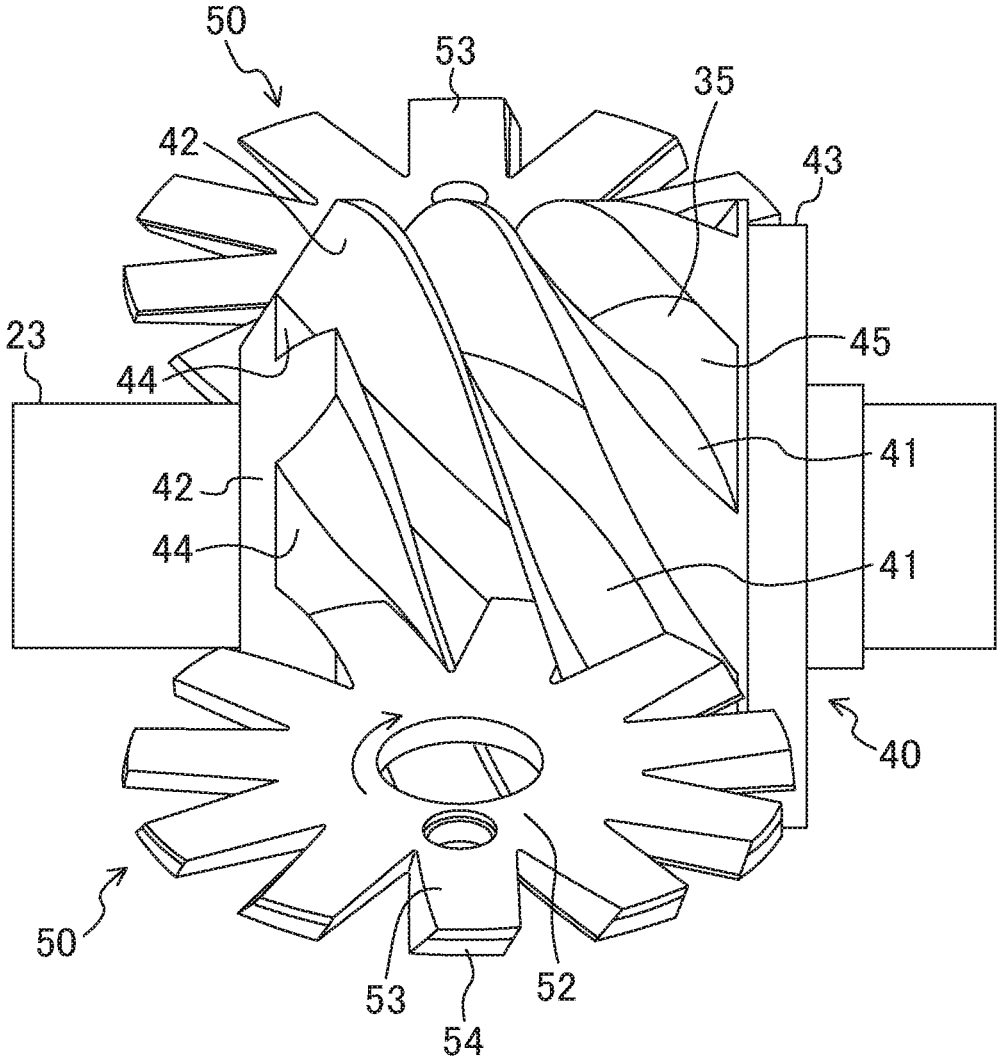
FIG. 4 is a perspective view illustrating a major part of the compression mechanism as viewed laterally.
Figure 5:
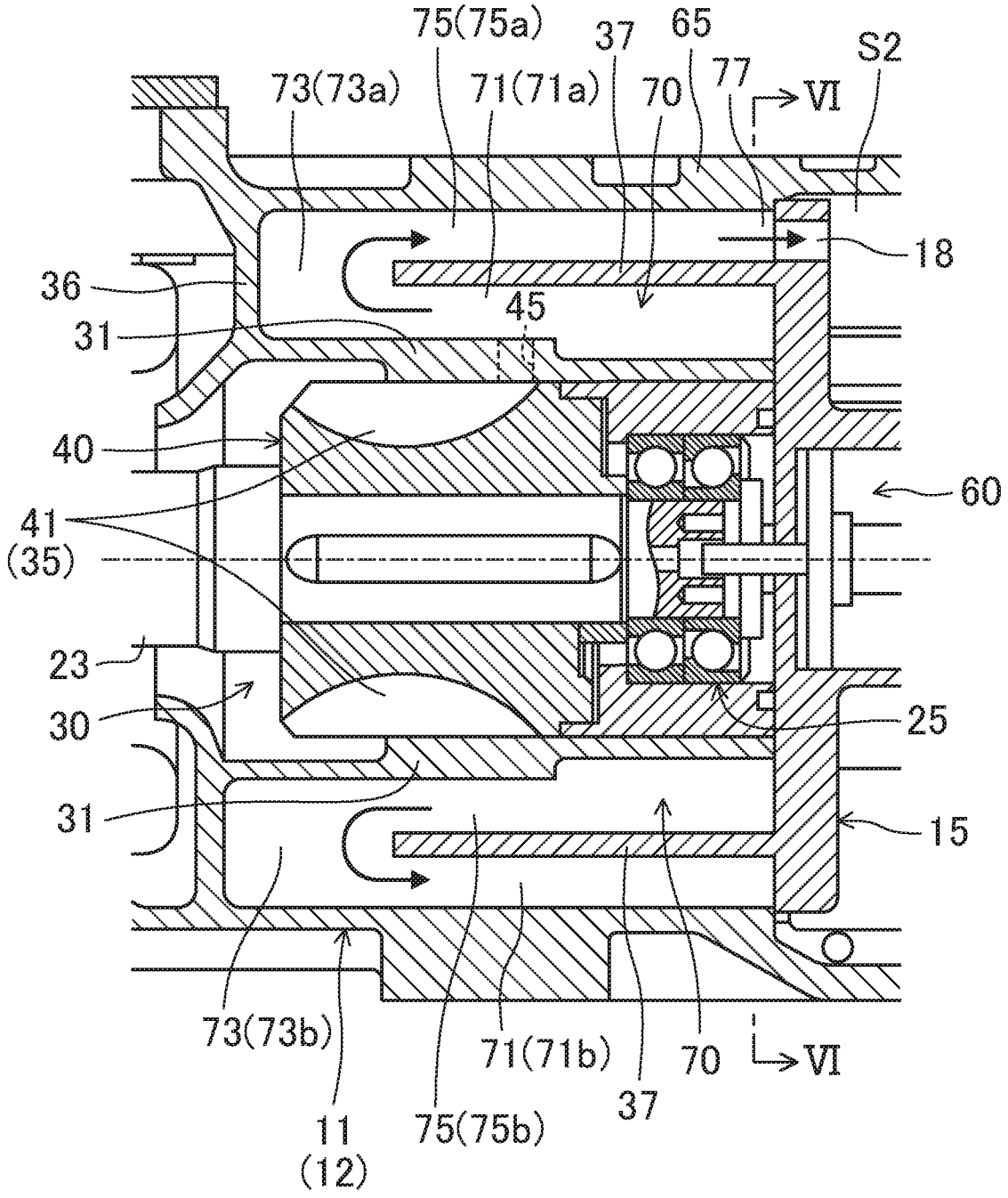
FIG. 5 is a view illustrating, on an enlarged scale, the vicinity of a discharge passage shown in FIG. 1.

The screw rotor (40) shown in FIGS. 1, 3, 4 and other drawings is housed in the cylinder (31). An outer peripheral surface of the screw rotor (40) is opposed to an inner peripheral surface of the cylinder (31) with a minute clearance left between them. A plurality of helical grooves (41) (six in this embodiment) are formed at the outer peripheral surface of the screw rotor (40). Each of the helical grooves (41) extends helically from a front axial end (left end in FIG. 1) to rear axial end (right end in FIG. 1) of the screw rotor (40).

The screw rotor (40) has a tapered portion (42) at a front end thereof. The tapered portion (42) forms an annular inclined surface which is flared toward the back. The screw rotor (40) has a circular plate (43) at a rear end thereof. The circular plate (43) is in the shape of a disc extending radially outward from an axial center of the screw rotor (40).

A starting end of each helical groove (41) is at the tapered portion (42). A portion of the helical groove (41) corresponding to the tapered portion (42) forms a suction port (44). The suction port (44) communicates with the low-pressure space (S1). A terminal end of each helical groove (41) is positioned forward of the tapered portion (43). The terminal end of the helical groove (41) opens radially outward, and communicates with a discharge port (45) formed in the cylinder (31) (see FIG. 1).

Gate Rotor

The two gate rotors (50) shown in FIGS. 2, 3, 4, and other drawings are respectively arranged on the sides of the screw rotor (40). The gate rotors (50) are arranged in line symmetry with respect to the axial center of the screw rotor (40). Each of the gate rotors (50) includes a single shaft (51), a single base (52), a plurality of arms (53), and a plurality of gates (54). Space around the shaft (51) and the base (52) is substantially at the same pressure as the low-pressure space (S1).

The shaft (51), extending in the vertical direction, is rotatably supported by a pair of bearings (27, 27) (gate bearings) as shown in FIG. 2. The axial center of the shaft (51) is present in a plane perpendicular to the axial center of the screw rotor (40).

The base (52) is integrated with one of the axial ends of the shaft (51) adjacent to the screw rotor (40). The base (52) is in the shape of a disc coaxial with the shaft (51). The base (52) has a larger outer diameter than the shaft (51).

The arms (53) extend radially outward from an outer peripheral surface of the base (52). The arms (53) are uniformly spaced in the circumferential direction. The gate rotor of this embodiment includes eleven arms (53), but the number of the arms (53) is not limited thereto.

The gates (54) are included in an integrated resin member fixed to the base. The gates (54) are formed on the surfaces of the arms (53). The gates (54) extend radially in the same manner as the arms (53). Each gate (54) has a larger width and a larger outer diameter than an associated one of the arms (53). The gates (54) are arranged around the base (52) to extend radially from the base (52). The gates (54) penetrate a portion of the cylinder (31) (see FIG. 2), and mesh with the helical grooves (41) of the screw rotor (40). In the compression mechanism (30), the screw rotor (40), the gates (54), and the cylinder (31) form the compression chamber (35).

Slide Valve Mechanism

The slide valve mechanism (60) includes a slide valve (61) and a drive mechanism (62). The slide valve (61) is housed in a valve housing (32) bulging radially outward from two different positions of the cylinder (31). The slide valve (61) is slidable in the axial direction (longitudinal direction) of the cylinder (31). An inner peripheral surface of the slide valve (61) partially constitutes the inner peripheral surface of the cylinder (31).

The drive mechanism (62) is coupled to the slide valve (61). The drive mechanism (62) changes the rotation angle of a vane motor (not shown), for example, thereby adjusting the position of the slide valve (61) via rods.

Discharge Passage

As shown in FIGS. 1, 2, 5, and 6, a discharge passage (70) is formed in the casing (11). The discharge passage (70) is formed by the suction side partition (36), a discharge side partition (15), the cylinder (31), and the outer peripheral wall (65) of the casing body (12).

The suction side partition (36) is formed between the low-pressure space (S1) and the discharge passage (70). The suction side partition (36) is comprised of an annular plate member extending from an inner peripheral surface of the outer peripheral wall (65) of the casing body (12) to the outer peripheral surface of the cylinder (31).

The discharge side partition (15) is a plate member formed between the discharge passage (70) and the high-pressure space (S2). A high-pressure communication passage (18) which allows the discharge passage (70) and the high-pressure space (S2) to communicate with each other is formed through the discharge side partition (15).

The discharge passage (70) heats the cylinder (31) with a high-pressure and high-temperature fluid (refrigerant) flowing therein. The discharge passage (70) includes two inner peripheral passages (71), two communication passages (73), and two outer peripheral passages (75). In the discharge passage (70), a refrigerant compressed in the compression mechanism (30) sequentially flows through the inner peripheral passages (71), the communication passages (73), and the outer peripheral passages (75).

Inner Peripheral Passage

The two inner peripheral passages (71) are formed along the outer peripheral surface of the cylinder (31). The two inner peripheral passages (71) include a first inner peripheral passage (71*a*) formed above the cylinder (31), and a second inner peripheral passage (71*b*) formed below the cylinder (31). The first and second inner peripheral passages (71*a*, 71*b*) are arranged, and shaped, in symmetry with respect to an axial center of the cylinder (31).

Each of the inner peripheral passages (71) has, for example, a substantially arc-shaped cross section (passage section) when viewed in section perpendicular to the axial center of the cylinder (31). The inner peripheral passages (71) extend in the axial direction of the cylinder (31) between the discharge side partition (15) and the suction side partition (36). Thus, almost the entire outer peripheral surface of the cylinder (31) is surrounded by the inner peripheral passages (71).

A discharge port (45) opens in each of the inner peripheral passages (71). The refrigerant compressed in the compression chamber (35) directly flows into the inner peripheral passages (71). That is, the refrigerant that has just been discharged flows into the inner peripheral passages (71). Thus, the refrigerant in the inner peripheral passages (71) causes relatively great discharge pulsation.

The communication passage (73) opens in a portion, of each of the inner peripheral passages (71), toward the low-pressure space (S1) (toward the suction side partition (36)). Thus, the refrigerant compressed in the compression chamber (35) goes into the inner peripheral passages (71) to flow in the axial direction of the cylinder (31) from the discharge side to suction side of the compression mechanism (30). The inner peripheral passages (71) are located in an upstream portion of the discharge passage (70), in which the refrigerant has the highest temperature. Specifically, the discharge passage (70) allows the cylinder (31) to be heated with the relatively high temperature refrigerant.

Communication Passage

The two communication passages (73) are formed near the suction side partition (36). The two communication passages (73) include a first communication passage (73*a*) formed above the cylinder (31), and a second communication passage (73*b*) formed below the cylinder (31).

The first communication passage (73*a*) is formed between an end (left end in FIG. 5) of the first inner peripheral passage (71*a*) and an end (left end in FIG. 5) of the first outer peripheral passage (75*a*). The first communication passage (73*a*) allows the first inner peripheral passage (71*a*) and the first outer peripheral passage (75*a*) to communicate with each other. That is, an outflow end of the first inner peripheral passage (71*a*), the first communication passage (73*a*), and an inflow end of the first outer peripheral passage (75*a*) are arranged continuously in the radial direction of the cylinder (31).

The second communication passage (73*b*) is formed between an end (left end in FIG. 5) of the second inner peripheral passage (71*b*) and an end (left end in FIG. 5) of the second outer peripheral passage (75*b*). The second communication passage (73*b*) allows the second inner peripheral passage (71*b*) and the second outer peripheral passage (75*b*) to communicate with each other. That is, an outflow end of the second inner peripheral passage (71*b*), the second communication passage (73*b*), and an inflow end of the second outer peripheral passage (75*b*) are arranged continuously in the radial direction of the cylinder (31).

Outer Peripheral Passage

The two outer peripheral passages (75) are formed along the inner peripheral surface of the outer peripheral wall (65) of the casing body (12). Specifically, the outer peripheral passages (75) are formed between the inner peripheral passages (71) and the outer peripheral wall (65). A cylindrical partition (37) is formed between the outer peripheral passages (75) and the inner peripheral passages (71).

The two outer peripheral passages (75) include a first outer peripheral passage (75*a*) formed above the first inner peripheral passage (71*a*), and a second outer peripheral passage (75*b*) formed below the second inner peripheral passage (71*b*). The first and second outer peripheral passages (75*a*, 75*b*) are arranged, and shaped, in symmetry with respect to the axial center of the cylinder (31).

Each of the outer peripheral passages (75) has, for example, a substantially arc-shaped cross section (passage section) when viewed in section perpendicular to the axial center of the cylinder (31). The outer peripheral passages (75) preferably have a smaller width in the radial direction than the inner peripheral passages (71). The outer peripheral passages (75) extend in the axial direction of the cylinder (31) between the discharge side partition (15) and the suction side partition (36). Thus, almost the entire outer peripheral surfaces of the inner peripheral passages (71) are surrounded by the outer peripheral passages (75) (see FIG. 6).

The communication passage (73) opens in a portion, of each of the outer peripheral passages (75), toward the low-pressure space (S1) (toward the suction side partition (36)). The refrigerant that has flowed out of the inner peripheral passages (71) flows into the outer peripheral passages (75). Thus, the refrigerant causes smaller discharge pulsation in the outer peripheral passages (75) than in the inner peripheral passages (71).

Figure 6:
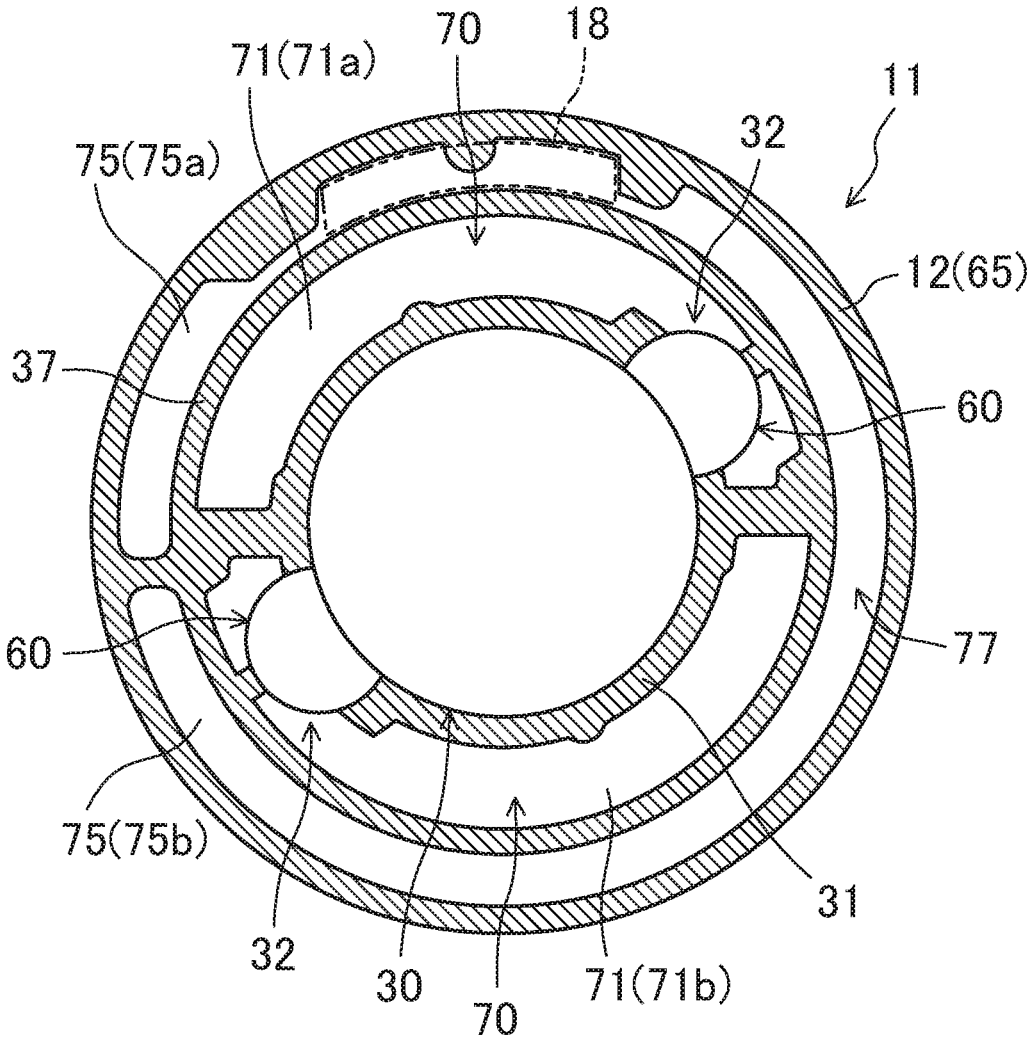
FIG. 6 is a cross-sectional view taken along line VI-VI of FIG. 5, illustrating the structure of a casing.

Portions of the two outer peripheral passages (75) toward the high-pressure space (S2) (toward the discharge side partition (15)) meet together at their outflow portions (77). Specifically, the outflow portions (77) of the two outer peripheral passages (75) form a continuous space. The outflow portions (77) of the two outer peripheral passages (75) communicate with the high-pressure space (S2) via a high-pressure communication passage (18). As shown in FIG. 6, the high-pressure communication passage (18) is formed at a top end of the discharge side partition (15), for example, and communicates with the first outer peripheral passage (75*a*). The high-pressure communication passage (18) may be, for example, in the shape of an arc extending in the whole passage section of the first outer peripheral passage (75*a*). Alternatively, two or more high-pressure communication passages (18) continuous with the first outer peripheral passage (75*a*) may be formed through the discharge side partition (15). In this configuration, the entire passage area of the high-pressure communication passage (18) increases, which can reduce pressure loss in the discharge passage (70).

In the outer peripheral passages (75), the refrigerant that has flowed out of the communication passages (73) flows in the axial direction of the cylinder (31) from the suction side to discharge side of the compression mechanism (30). Specifically, in the discharge passage (70), the refrigerant flows in a certain direction in the inner peripheral passages (71), and flows in an opposite direction to the certain direction in the outer peripheral passages (75). Thus, the refrigerant makes a U-turn in the discharge passage (70) as it passes through the communication passages (73). As a result, the discharge pulsation of the refrigerant flowing into the outer peripheral passages (75) is further reduced.

Operation

It will be described how the screw compressor (10) is operated. Once the motor (20) is driven, the drive shaft (23) and the screw rotor (40) rotate. The rotation of the screw rotor (40) allows the gate rotors (50) meshing with the helical grooves (41) to rotate. Thus, the compression mechanism (30) continuously repeats a suction process, a compression process, and a discharge process. The processes will be described below with reference to FIG. 7(A) to 7(C).

Figures 7A, 7B, 7C:
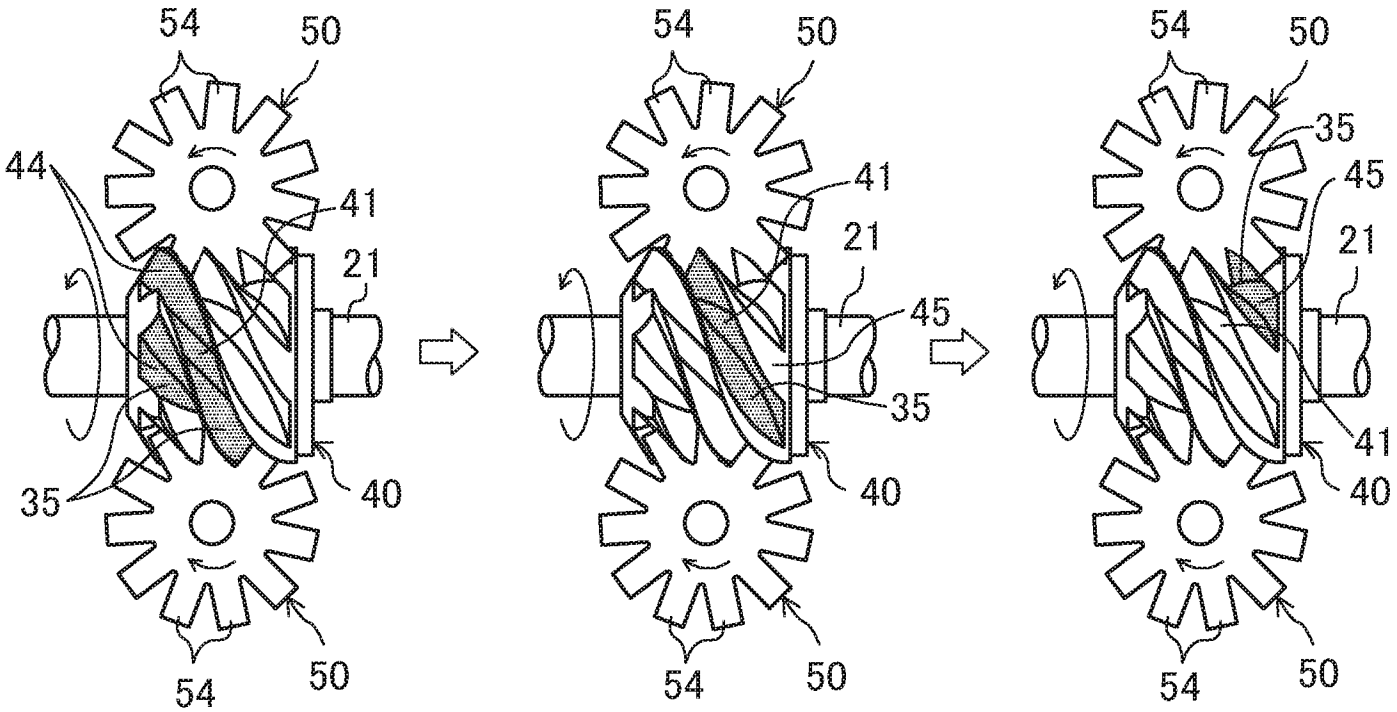
FIGS. 7(A) to 7(C) are schematic plan views respectively illustrating a suction process, compression process, and discharge process of the screw compressor.

In the suction process shown in FIG. 7(A), the compression chamber (35), which is hatched (a suction chamber in a strict sense), communicates with the low-pressure space (S). The helical groove (41) corresponding to the compression chamber (35) meshes with an associated one of the gates (54) of the gate rotor (50). As the screw rotor (40) rotates, the gate (54) relatively moves toward the terminal end of the helical groove (41), thereby increasing the capacity of the compression chamber (35) As a result, the low pressure refrigerant in the low-pressure space (S1) is sucked into the compression chamber (35) through the suction port (44).

As the screw rotor (40) further rotates, the compression process shown in FIG. 7(B) is performed. In the compression process, the hatched compression chamber (35) is fully closed. Specifically, the helical groove (41) corresponding to this compression chamber (35) is divided from the low-pressure space (S) by the gate (54). As the screw rotor (40) rotates, the gate (54) approaches the terminal end of the helical groove (41), and the capacity of the compression chamber (35) gradually decreases. As a result, the refrigerant in the compression chamber (35) is compressed.

As the screw rotor (40) further rotates, the discharge process shown in FIG. 7(C) is performed. In the discharge process, the compression chamber (35), which is hatched (a discharge chamber in a strict sense), communicates with the discharge passage (70) via the discharge port (45). As the screw rotor (40) rotates, the gate (54) approaches the terminal end of the helical groove (41), and the compressed refrigerant is pushed out of the compression chamber (35) into the discharge passage (70).

Through the positional adjustment of the slide valve (61) by the slide valve mechanism (60), the flow rate of the refrigerant (the amount of the circulating refrigerant) sent from the compression mechanism (30) to the high-pressure space (S2) is controlled. If the motor (20) is an inverter drive motor, the compression ratio of the compression mechanism (30) may be controlled by adjusting the position of the slide valve (61).

The refrigerant that has been compressed to become a high-temperature and high-pressure refrigerant in the compression chamber (35) flows into the inner peripheral passages (71) via the discharge ports (45). As the refrigerant is intermittently discharged from the discharge ports (45), the refrigerant causes relatively great discharge pulsation in the inner peripheral passages (71). Being surrounded by the outer peripheral passages (75), the inner peripheral passages (71) do not face the outer peripheral wall (65) of the casing body (12). Therefore, the discharge pulsation in the inner peripheral passages (71) is not easily transmitted to the outside of the casing (11), which can reduce the noise derived from the discharge pulsation.

The refrigerant that has flowed into the inner peripheral passages (71) flows along the outer peripheral surface of the cylinder (31) from the discharge side to suction side of the compression mechanism (30). The refrigerant flowing through the inner peripheral passages (71) is a relatively high temperature refrigerant that has just been compressed. Thus, the cylinder (31) can efficiently be heated. In this configuration, owing to the difference in thermal expansion properties between the screw rotor (40) and the cylinder (31), contact between the inner peripheral surface of the cylinder (31) and the rotating screw rotor (40) can be prevented.

The fluid that has flowed out of the inner peripheral passages (71) flows through the outer peripheral passages (75) via the communication passages (73). The outer peripheral passages (75) are located downstream of the inner peripheral passages (71), and are relatively far from the discharge ports (45). Thus, the refrigerant does not cause great discharge pulsation in the outer peripheral passages (75). This can reduce the noise coming out of the casing (11).

The refrigerant in the inner peripheral passages (71) makes a U-turn to flow into the outer peripheral passages (75). This can reduce the discharge pulsation of the refrigerant that has flowed into the outer peripheral passages (75), which can further reduce the noise coming out of the casing (11).

Flows of the refrigerant that have passed through the outer peripheral passages (75) merge together at the outflow portions (77), and then the merged refrigerant flows into the high-pressure space (S2) via the high-pressure communication passage (18). The refrigerant that has flowed into the high-pressure space (S2) passes through the demister (17) which separates the oil from the refrigerant, and is discharged out of the casing (11) via the discharge portion (14*a*). The oil separated in the demister (17) is stored in the oil sump (19).

Advantages

According to the embodiment described above, the outer peripheral passages (75) are provided between the inner peripheral passages (71) and the outer peripheral wall (65) of the casing (11). This can reduce the noise derived from the pulsation of the refrigerant.

Further, the inner peripheral passages (71), in which a relatively high temperature refrigerant flows, are formed along the outer peripheral surface of the cylinder (31). This can heat the cylinder (31) with the fluid more efficiently. As a result, the seizing of the screw rotor (40) can effectively be avoided.

In the discharge passage (70), the refrigerant makes a U-turn. This can reduce the discharge pulsation of the fluid flowing through the outer peripheral passages (75), thereby further reducing the noise. The outer peripheral passages (75) entirely covering the inner peripheral passage (71) make it possible to further reduce the noise coming out of the casing (11).

Other Embodiments

The discharge passage (70) of the above-described embodiment includes the two inner peripheral passages (71*a*, 71*b*), the two communication passages (73*a*, 73*b*), and the two outer peripheral passages (75*a*, 75*b*). Alternatively, the number of each passage may be one, or three or more.

The refrigerant does not always flow in opposite directions different by 180 degrees in the inner peripheral passages (71) and the outer peripheral passages (75). The refrigerant may make a turn at an angle smaller than 180 degrees in the discharge passage (70).

The outer peripheral passages (75) may cover the outer peripheral surfaces of the inner peripheral passages (71) only partially.

INDUSTRIAL APPLICABILITY

As can be seen from the foregoing, the present invention is useful for a screw compressor.

The invention claimed is:

1. A screw compressor, comprising:

a casing having an outer peripheral wall; and a compression mechanism including a screw rotor provided with helical grooves, a gate rotor including a plurality of gates meshing with the helical grooves, and a cylinder housing the screw rotor, the compression mechanism being disposed inward of the outer peripheral wall, the outer peripheral wall having a discharge passage formed therein through which a fluid compressed in the compression mechanism flows, the cylinder having a discharge port arranged to discharge the fluid compressed in the compression mechanism, and the discharge passage including an inner peripheral passage formed along an outer peripheral surface of the cylinder to extend in an axial direction of the cylinder and in which the discharge port opens, and an outer peripheral passage formed along the inner peripheral passage and the outer peripheral wall to extend in the axial direction of the cylinder, the inner peripheral passage and the outer peripheral passage being formed so that the fluid compressed in the compression mechanism sequentially flows through the inner peripheral passage and the outer peripheral passage.

2. The screw compressor of claim 1, wherein an outer peripheral surface of the inner peripheral passage is entirely surrounded by the outer peripheral passage.

3. The screw compressor of claim 1, wherein the discharge passage allows a fluid to flow in a certain direction in the inner peripheral passage and to flow in an opposite direction to the certain direction in the outer peripheral passage, and the discharge passage includes a communication passage which allows a downstream end of the inner peripheral passage to communicate with an upstream end of the outer peripheral passage.

4. The screw compressor of claim 3, wherein an outer peripheral surface of the inner peripheral passage is entirely surrounded by the outer peripheral passage.

* * * * *